United States Patent [19]

Whight

[11] 4,104,814

[45] Aug. 8, 1978

[54] CLEAN TOWEL PRESENTING MACHINE

[76] Inventor: Leonard A. Whight, Cornelie van Zantenstraat 296, The Hague, Netherlands

[21] Appl. No.: 764,891

[22] Filed: Feb. 1, 1977

[30] Foreign Application Priority Data

Feb. 2, 1976 [NL] Netherlands ..... 7601031

[51] Int. Cl.[2] ..... A47K 10/30

[52] U.S. Cl. ..... 38/2; 68/13 R; 68/18 C; 68/175

[58] Field of Search ..... 68/13 R, 18 C, 18 F, 68/18 R, 15, 16, 175, 19; 226/127–133; 221/27–29; 38/2, 7; 21/81; 15/40; 312/38

[56] References Cited

U.S. PATENT DOCUMENTS

| | | | |
|---|---|---|---|
| 2,295,955 | 9/1942 | LaPage | 68/13 R X |
| 2,593,640 | 4/1952 | Whittington | 68/15 |
| 2,609,623 | 9/1952 | Miller | 68/13 R X |
| 2,963,893 | 12/1960 | Kusters | 68/175 |
| 3,083,481 | 4/1963 | Kamen | 68/13 R X |
| 3,112,631 | 12/1963 | Gordon | 68/13 R X |
| 3,173,766 | 3/1965 | Severance | 68/18 C X |
| 3,803,879 | 4/1974 | Holm | 68/18 C X |
| 3,826,548 | 7/1974 | Schnyder et al. | 312/38 |
| 4,010,988 | 3/1977 | Schwartz | 312/38 |

FOREIGN PATENT DOCUMENTS

| | | | |
|---|---|---|---|
| 506,389 | 9/1930 | Fed. Rep. of Germany | 68/13 R |
| 1,900,676 | 8/1970 | Fed. Rep. of Germany | 68/13 R |
| 2,230,522 | 1/1974 | Fed. Rep. of Germany | 68/13 R |

*Primary Examiner*—Philip R. Coe

*Attorney, Agent, or Firm*—Stevens, Davis, Miller & Mosher

[57] ABSTRACT

A clean towel presenting machine, which includes a casing having a delivery slot and an intake slot, an endless web of liquid absorbent material contained in the casing , part of which depends from the delivery slot at the front of the casing and the intake slot, the web being adapted, when it is manually pulled out of the delivery slot, to discontinuously present a clean portion and simultaneously retract an essentially equal used portion through the intake slot, cleaning liquid tank and a heater to dry and sterilize the web.

7 Claims, 2 Drawing Figures

CLEAN TOWEL PRESENTING MACHINE

The present invention relates to a clean towel presenting machine, which comprises a casing containing a web of liquid absorbent material, part of which depends from a delivery slot at the front of the casing and reenters the machine at an intake slot, said web being adapted, when it is manually pulled out of the delivery slot, to discontinuously present a clean portion and simultaneously retract an essentially equal used portion through the intake slot. Clean towel presenting machines of this description are widely used in wash facilities, in offices and other industrial buildings.

In conventional clean towel presenting machines the absorbent web, which is usually made of textile material, is wound on a supply roll and from there passes out through the delivery slot and then through the intake slot back into the casing where it is wound on a receiver roll. By manually pulling the web out of the delivery slot a clean web length of 18 to 20 cm becomes available, whereupon a mechanism inside the casing is arrested for a certain (short) retarding time during which no further length of towel can be pulled out. Simultaneously, an approximately equal web length is retracted into the casing and wound on the receiver roll.

The disadvantage of these conventional clean towel presenting machines is that when the web of absorbent material has been used up it must be replaced. Thereto, it is necessary to open the casing, remove the loaded receiver roll and install a clean roll. Dependent on the use, a new supply roll has to be installed once or twice a week, which is an undesirable complication. The removed used rolls are then collected, cleaned and returned by a specialised laundry which involves additional expenses.

The object of the invention is to provide a clean towel presenting machine which is capable of unsupervised operation over a long period of time, conceivably in the order of a year.

According to the invention, this object is achieved in that the web of liquid absorbent material is an endless web and the casing includes web cleaning means and web drying and sterilizing means.

When the clean towel presenting machine according to the invention is used in offices and the like, where no dirty work is performed, the towel is predominantly used for merely wiping hands and, therefore, does not become severely soiled so that web cleaning need not be intensive, and the accent is more laid on the drying and sterilizing means.

According to a preferential embodiment, the web cleaning means comprises a tank containing cleaning liquid through which the web is transported by special wash rolls. The web drying and sterilizing means comprises one or more heaters along which the web is passed. The web drying means may be assisted by one or more fans which generate a current of air circulating inside the casing and along the web.

In order to keep the air current dry the casing may also include a condenser. This condenser can then be cooled by means of the cleaning liquid.

Furthermore, the cleaning liquid may be pumped through a filter so that the useful life of the cleaning liquid may be extended.

Further advantageous embodiments are specified in the subclaims.

An embodiment of the invention will now be explained by way of an example with reference to the drawing, wherein.

Figure 1:
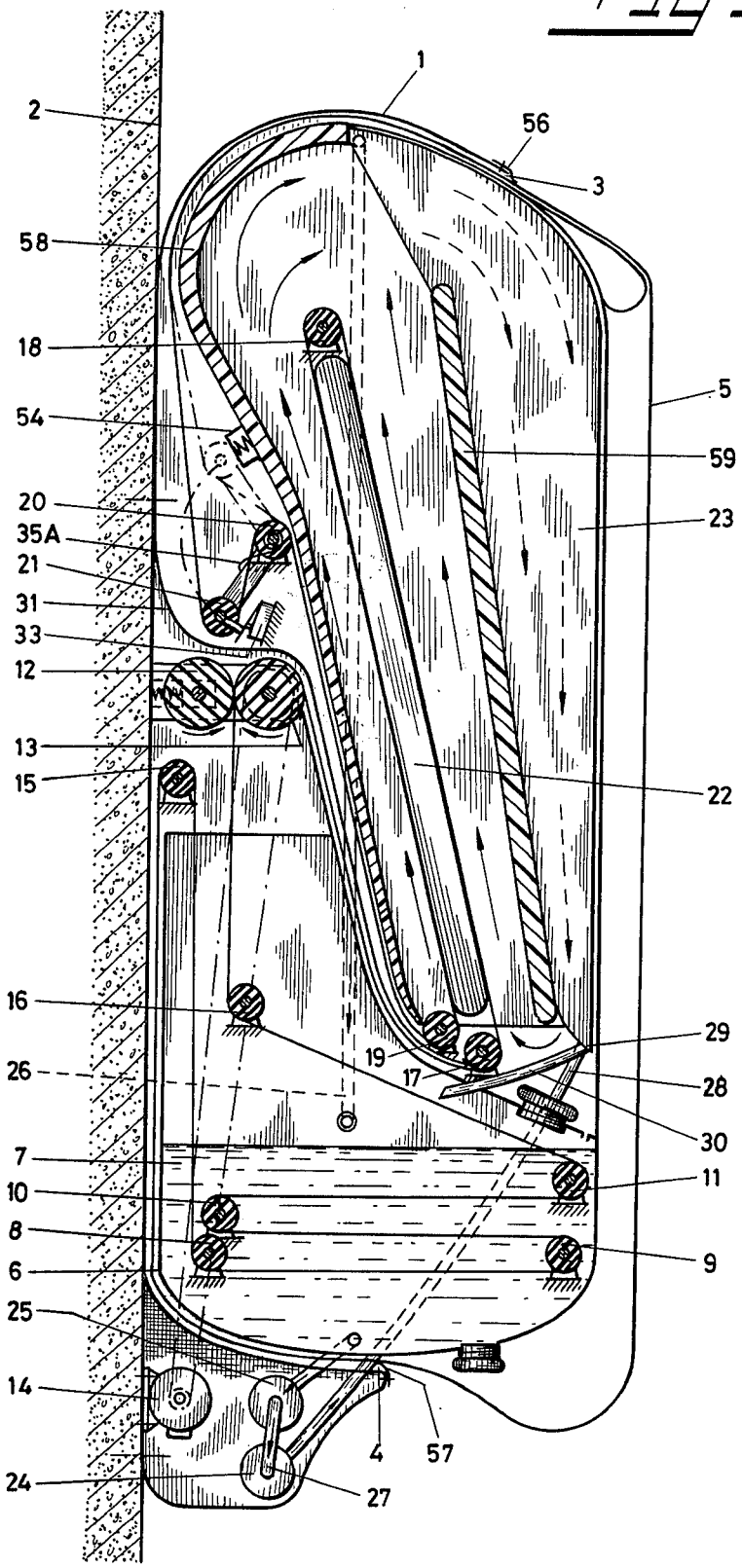
FIG. 1 shows a longitudinal cross section of the clean towel presenting machine.

It may be seen from FIG. 1 that the clean towel presenting machine is provided with a casing 1, which may be secured to a wall 2 at a suitable level. Floor mounted models are also possible. The casing 1 has a delivery slot 3 and an intake slot 4. The towel 5, which is in the form of an endless web of liquid absorbent material, enters the casing 1 through the intake slot 4 and travels over guide roller 15, after which towel 5 passes through a tank 6 containing cleaning liquid 7. This tank 6 has a number of immersed wash rolls 8 - 11 mounted therein around which the towel 5 is passed. The towel 5 is subsequently withdrawn from the tank 6 around roll 16 by a pair of drive rolls 12, 13 which are driven by a motor 14 and at the same time serve to remove excess liquid from the towel. The towel 5 then passes round a number of guide rolls 17 - 21, between which it is dried and sterilized as will be later explained. After passing over the last one 21 of these guide rolls, the towel 5 leaves the casing 1 through the delivery slot 3.

In the loop of the towel between the guide rolls 17 - 19 a heater 22 is positioned which also acts as a smoothing iron and which expels the cleaning liquid from the towel 5 by evaporation and sterilizes the towel 5 by heating. Inside the casing 1 air and cleaning liquid 7 vapour circulate in the direction of the arrows shown in FIG. 1. This air and cleaning liquid 7 vapour circulation is caused by the temperature difference in the two near vertical and near parallel circulating paths provided and may be assisted by circulating fans, not shown. By these means the cleaning liquid vapour is caused to come into contact with the condenser 23. This condenser 23 is cooled by means of cleaning liquid 7 from the tank 6, which is circulated by a pump 24 from the bottom of the tank through a filter 25, pipes 27 and 28 and through a pipe 26 from the condenser 23 back to the top of the tank 6.

The condenser 23 condenses the vapour entrained in the air current by the action of the heating element 22 and the condensed liquid, thus formed, flows down the condenser 23 surfaces and into the trap 29, from which this condensed liquid flows through pipe 30, and back to towel 5, at a point above the cleaning liquid 7 level, so that the towel 5 is caused to be rinsed by this condensed liquid. The condensed liquid then passes over and through the towel 5 and falls back into tank 6.

The last guide roll 21 is pivoted, at each end, about the fixed fulcrum of the adjacent guide roll 20 by means of links 31 and 32. Link 32 is not shown. Below link 31 at the spindle end of the roll 21, a microswitch 33 is positioned and serves to initiate the timer 34 and the drive motor 14.

The links 31, 32 are normally held in their lowermost position by torsion springs 35A, 35B as illustrated in FIG. 1. Torsion spring 35B is not shown.

Figure 2:
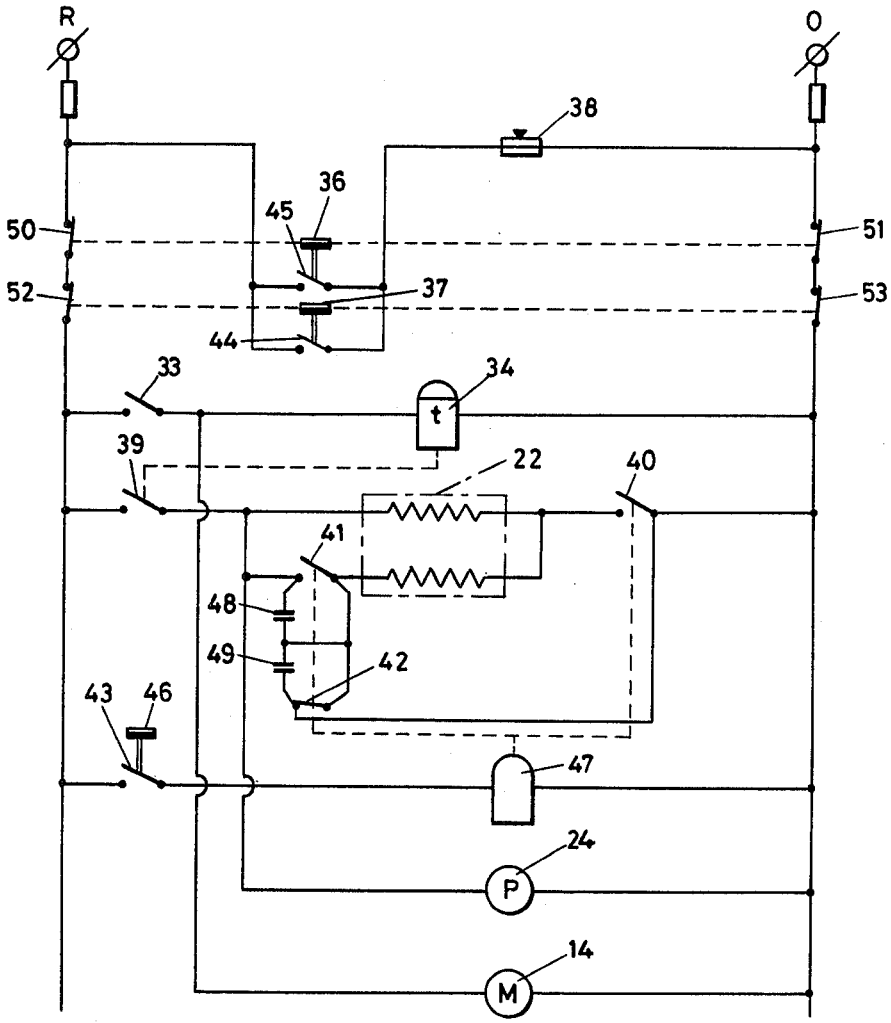
FIG. 2 shows the electric circuit diagram of the clean towel presenting machine.

FIG. 2 represents the electrical circuit diagram of the clean towel presenting machine according to the invention.

Between the phase wire R and the neutral wire O of the electrical power supply four electrical circuits are connected. The first or uppermost electric circuit consists of the thermostats 36 and 37 and includes the switches 44 and 45, which initiate a visual "overload" alarm 38. Thermostat 36 which includes electrical contacts 45, 50 and 51 is preset and arranged to monitor the cleaning liquids 7 hottest temperature. When the cleaning liquid 7 temperature rises to a predetermined maximum permissable temperature, the thermostat 36 opens switch contacts 50, 51 and closes contact 45 to disconnect the electric circuit from the power supply and simultaneously illuminate the visual "overload" alarm 38. Thermostat 37, which includes electrical contacts 44, 52 and 53, is preset and arranged to monitor the casing's hottest spot temperature. When the casing's hottest spot temperature rises to a predetermined maximum permissable temperature, the thermostat 37 opens switch contacts 52, 53 and closes contact 44 to disconnect the electric circuit from the power supply and simultaneously illuminate the visual "overload" alarm 38.

The second electrical circuit consists of the microswitch 33 which is actuated by the links 31, 32 and which microswitch 33 is directly electrically connected to timer 34 and to drive motor 14. Timer 34, is started as soon as links 31, 32 are pulled up and microswitch 33 closes. From the moment that timer 34 is energized by the last operation of microswitch 33, timer 34 will hold contact 39 in the closed position for a predetermined period of time using stored electrical or mechanical energy. The drive motor 14 is energized when the microswitch 33 is closed by the lifting of the links 31, 32. The drive motor 14 is de-energized when the links 31, 32 are pulled to their normal resting position by the torsion springs 35A, 35B.

The third electrical circuit consists of contact 39, associated with timer 34, heater 22, the elements of which are arranged for series/parallel operation, contacts 40, 41, 42 associated with relay 47, arc suppression capacitors 48, 49 and pump 24. When timer 34 contact 39 is closed, the heater 22 elements are energized in series through relay 47 contact 42 as shown in FIG. 2. By the action of relay 47, which will be described later, relay 47 contacts 40, 41 may be closed and relay 47 contact 42 opened so as to cause the heater 22 elements to be connected in parallel which results in an increased heater rating and a correspondingly faster heater 22 temperature rise. Pump 24 is also energized when contact 39 is closed. Pump 24 operates whenever the heater 22 is energized either in series or parallel.

The fourth electrical circuit consists of the thermostat 46, and its associated contact 43, together with the operating coil of relay 47. Thermostat 46 is preset and arranged to monitor the surface temperature of the heater 22. When the surface temperature of heater 22 is below a predetermined value, thermostat 46 will maintain contact 43 in a closed position so as to energize the operating coil of relay 47. Relay 47 contacts 40, 41 will then be closed and contact 42 will be open. This will connect heater 22 elements in parallel and will cause the maximum rate of heating of heater 22. When the surface temperature of heater 22 rises to the predetermined value, thermostat 46 will open its associated contact 43 so that relay 47 will be de-energized. This will cause relay 47 contacts 40, 41 to open and contact 42 to close so that heater 22 elements will be connected in series and will cause the minimum rate of heating of heater 22.

The operation of the unit will now be described partly with reference to FIG. 2, which illustrates a basic electrical circuit. It is to be understood that other electrical circuits are possible.

When a length of clean towel is pulled out of the delivery slot 3 in the casing 1, in the first instance the links 31, 32 move up to the dot and dash line position in FIG. 1, in which they abut against stops 54, 55 respectively. Stop 55 is not shown. A length of clean towel of approximately 20 cm has then become available. Due to the links 31, 32 now having released the microswitch 33, the latter is closed. As appears from the second electrical circuit in FIG. 2, this results in the drive motor 14 for the drive rolls 12, 13 being switched on, so that the length of towel pulled out of the casing 1, is replenished by these drive rolls 12, 13 by pulling a corresponding length of towel via the bath of cleaning liquid 7 through the intake slot 4 into the casing 1. The towel portion beyond the driven rolls 12, 13 which passes around the guide rolls 17 - 21 is maintained taut by the torsion springs 35A, 35B which pull the links 31, 32 down again. Blocking members (not shown in the drawing) contained within casing 1, adjacent to delivery slot 3, prevent the length of clean towel from being pulled back through the delivery slot 3. The drive motor 14 of the drive rolls 12, 13 is switched off as soon as the links 31, 32 have returned to their lowermost position, thereby re-opening the microswitch 33.

The links 31, 32, after ascending and closing microswitch 33, also cause the timer 34 to close its associated contact 39. Timer 34 then stores sufficient electrical or mechanical energy to maintain contact 39 closed for a predetermined period after microswitch 33 has reopened. While contact 39 is closed the action of the heater 22 and the pump 24 is as previously described.

When the links 31, 32 have descended to their lowest position, another full length of towel 5 may be pulled out from the casing 1 through delivery slot 3. If the towel 5 is pulled from the casing 1 before links 31, 32 have descended to their lowest position, a proportionally shorter length of towel 5 is delivered.

The delivery slot 3 and the intake slot 4 are preferably provided with squeegees 56, 57 which press against the towel 5. In this way the casing is sufficiently sealed from its surroundings in order to minimise the loss of moisture.

Various embodiments of the clean towel presenting machine are possible within the scope of the invention.

Thus, the cleaning liquid may consist of water with or without washing agents added thereto, while also steam with or without improvers, a solvent and/or solvent vapour or combinations thereof may be used.

The cleaning method may be based on the use of "wash rolls". These immersed wash rolls 8 - 11, have outer flexible cellular layers which have the ability to absorb cleaning liquid 7 when they are not held under pressure by the transport of the towel 5. Those sectors of the wash rolls 8 - 11, which are in contact with the towel 5, will then, under the influence of the towel 5, pressure discharge cleaning liquid 7 through the towel 5. This action is repeated according to the number of wash rolls 8 - 11 employed, each wash roll 8 - 11 forcing cleaning liquid 7 through the towel 5 in alternate directions. Heavy duty machines, as described, may use larger numbers of the wash rolls 8 - 11 or an agitator, rotating brushes, ultrasonic vibrations, cleaning liquid jets, or a combination of any of these methods.

Rinsing means may further be provided between the cleaning means and the drying means, which may operate with neutralizing agents, air, gas or vapour, water, solvents or combinations of these mediums.

The rinsing operation itself may be performed by treating the towel with a neutralizing agent in order to obtain a chemically inert residue. The washing medium may also be removed by means of an air current. The towel may be rinsed with condensed water or a solvent. To render rinsing superfluous, a 'safe' washing agent may be employed. Combinations of any of these methods are also possible.

Finally an additional sterilization device may be incorporated in the clean towel presenting machine according to the invention. Slow dissolving sterilizing agents may for instance be added to the cleaning liquid. The sterilization may also take place by electrolytic methods, heaters, sterilizing lamps such as ultraviolet lamps or a combination of any of these methods.

The various rolls employed in the clean towel presenting machine may be removable so that the endless towel can be manufactured in the factory and the need for making towel joints in situ is avoided.

Excess liquid may also be removed from the towel by causing the towel to vibrate.

In order to ventilate the machine interior and to ensure its immediate availability for a number of consecutive operations, it may be necessary to operate the heaters and fans whilst the unit is otherwise out of use.

Both the cleaning liquid tank and the drying compartment preferably have rounded internal corners to permit good air and liquid scouring and so prevent the accumulation of dirt.

When condensed liquids are required to be used for rinsing, the driven rolls 12, 13 may be arranged to remove a minimum of liquid so as to increase the amount of liquid condensed at the condenser.

The area surrounding the heater 22 on all sides is preferably thermally insulated as at 58, 59 to prevent the formation of condensed cleaning liquid 7 on surfaces other than the condenser and to optimize the natural circulation of the air and cleaning liquid 7 vapour.

The liquid level in the immersion compartment may rise in service, due to the transfer of water to the towel from wet hands. This can be corrected by a float operated ventilator to expel humid vapour to the surroundings, until the level is corrected, or by means of an overflow pipe into a storage area provided for the purpose.

Also, in service vapour may be lost thereby causing the liquid level to fall. In this case liquid make up may be supplied from a small storage tank using natural head pressure.

I claim:

1. Automatic towel machine for cleaning, drying and gradually dispensing an endless web, comprising a substantially closed casing having at the front side a delivery slot and an intake slot for the web, said casing enclosing a web cleaning part, to be filled with cleaning liquid, a web drying part provided with at least one heating element, a condenser for condensing the vaporous cleaning agent, said condenser communicating with the cleaning part for the flow back of condensed cleaning agent to said cleaning part, and casing guide means for guiding the web from the intake slot through said cleaning part and said drying part to said delivery slot, said condenser being in an individual space separated from the drying part by a thermally insulating partition, said drying part and said condenser space communicating with each other at two spaced locations, said drying part and condenser being positioned above said cleaning part so that natural and/or forced circulation of the vaporous cleaning agent may pass through the drying part, the condenser space and said communications.

2. The automatic towel machine according to claim 1, including pipes between said cleaning part and said condenser to circulate the cleaning liquid from the cleaning part to the condenser and back and a pump within said cleaning part to move said liquid.

3. The automatic towel machine according to claim 1, including a heating element within said drying part and in the drying part the web is guided along the heating element in continuous contact with said element.

4. The automatic towel machine according to claim 1, including a spring, a pivotable lever, a driving motor and a switching device, one of said guiding means being mounted on said pivotable lever, said lever being pivoted against action of said spring upon pulling the web across a certain distance from the delivery slot, said driving motor driving a web guiding means, said switching device operating said motor for a time period corresponding with the passing of a web length equal to the web length pulled out maximally from the delivery slot.

5. The automatic towel machine according to claim 1, including elastic sealing strips provided at both the delivery and intake slots.

6. The automatic towel machine according to claim 1, wherein at least one of said guide means is roll-shaped and positioned in the cleaning liquid, said guide means being provided with an outer flexible layer of cell structure, said web being guided around said roll across a certain angle.

7. The automatic towel machine according to claim 1, including at least two or more heating elements in the drying part which are connected in series when the temperature in that part is higher than a predetermined value and connected in parallel when the temperature in that part is lower than the mentioned value.

* * * * *